US006892419B1

(12) United States Patent
Duprey

(10) Patent No.: US 6,892,419 B1
(45) Date of Patent: May 17, 2005

(54) SCALLOPED EDGE DUSTPAN

(76) Inventor: John F. Duprey, 807 Sixth St., Watervliet, NY (US) 12189

( * ) Notice: Subject to any disclaimer, the term of this patent is extended or adjusted under 35 U.S.C. 154(b) by 0 days.

(21) Appl. No.: 10/790,742

(22) Filed: Mar. 3, 2004

(51) Int. Cl.[7] ..... A47L 13/52

(52) U.S. Cl. ..... 15/257.9; 15/257.1; 294/55; 294/56; D32/74

(58) Field of Search ..... 15/257.1–257.9, 15/245.1, 236.08; D32/74; 294/55, 1.3, 1.4, 54.5, 56; 81/45

(56) References Cited

U.S. PATENT DOCUMENTS

| | | | | | |
|---|---|---|---|---|---|
| 719,943 | A | * | 2/1903 | Hopkins | 15/257.1 |
| 1,181,135 | A | * | 5/1916 | Harrison | 294/56 |
| 1,241,779 | A | * | 10/1917 | Suydam | 15/236.08 |
| 2,020,293 | A | * | 11/1935 | Adelstein | 15/105 |
| 2,117,174 | A | * | 5/1938 | Jones | 15/110 |
| 2,252,879 | A | * | 8/1941 | Calame | 451/214 |
| 2,563,223 | A | | 8/1951 | Dreher | |
| 3,118,165 | A | * | 1/1964 | Meyerhoefer | 15/402 |
| 3,232,505 | A | * | 2/1966 | Wyant | 225/18 |
| 3,495,352 | A | * | 2/1970 | Sbare | 47/33 |
| 3,917,333 | A | | 11/1975 | Grattan | |
| 4,969,289 | A | * | 11/1990 | Trifiletti | 47/33 |
| D345,238 | S | | 3/1994 | Berti | |
| D347,497 | S | | 5/1994 | VanSkiver | |
| 5,325,565 | A | | 7/1994 | Suzuki | |
| 5,473,790 | A | | 12/1995 | Desmarais | |
| 5,738,399 | A | | 4/1998 | Mitchell | |
| 5,809,605 | A | * | 9/1998 | Gringer | 15/121 |
| 6,234,549 | B1 | | 5/2001 | Brownell | |
| 6,237,181 | B1 | | 5/2001 | Onuffer | |
| 6,249,930 | B1 | | 6/2001 | Noggle | |
| D466,262 | S | | 11/2002 | Chemtob | |
| 2002/0008392 | A1 | | 1/2002 | Harrison | |
| 2002/0088075 | A1 | | 7/2002 | Cann | |

FOREIGN PATENT DOCUMENTS

| | | |
|---|---|---|
| JP | 8-98790 | 4/1996 |

* cited by examiner

*Primary Examiner*—Gary K. Graham
(74) *Attorney, Agent, or Firm*—Richard C. Litman

(57) ABSTRACT

The scalloped edge dustpan is eliminates the line of dust or debris that is often left on the floor when dust or debris is swept in to a conventional, straight-edge dustpan. is a dustpan in which the front or leading edge of the base or blade has is formed with a continuous series of semicircular segments or protrusions forming a scalloped edge. The scallops may be beveled so that the scalloped edge tapers downward towards the front of the base. The dustpan may be formed with the base and the leading edge formed as a single piece of material, or the scalloped edge may be formed as a strip attached to the front of a dustpan blades leading edge by adhesive or fasteners.

14 Claims, 3 Drawing Sheets

SCALLOPED EDGE DUSTPAN

BACKGROUND OF THE INVENTION

1. Field of the Invention

The present invention relates to a dust-collecting apparatus generally known as a dustpan, and more particularly to a dustpan that features a scalloped edge on the lip of the dustpan.

2. Description of the Related Art

Most people in the course of their life have occasion to sweep the floor using a broom. Typically a person uses a broom to sweep dust or other debris from the various parts of a room to a central location. At this point the swept debris is often further swept into a dustpan so that it may be picked up and disposed of in a garbage can or other receptacle. One problem with using a dustpan is that when the debris has been swept into the dustpan, there is often a line of debris remaining on the floor along the lip of the dustpan. A variety of improved dustpans and other scoop-like devices have been proposed, but none have satisfactorily addressed this problem.

U.S. Design Patent No. 345,238, issued Mar. 15, 1994 to Enzo Berti, shows an ornamental design for a dustpan featuring a straight lip that is beveled. U.S. Design Patent No. 347,497, issued May 31, 1994 to Ralph VanSkiver, depicts an ornamental design for a litter scoop that also has a straight lip that is beveled. U.S. Design Patent No. 466,262, issued Nov. 26, 2002 to Andre Chemtob, portrays an ornamental design for a dustpan where the lip of the dustpan curves downward.

U.S. Patent Publication No. 2002/0008392, published Jan. 24, 2002, describes an animal refuse shovel that features a straight, protruding leading edge. U.S. Patent Publication No. 2002/0088075, published Jul. 11, 2002, shows a standup dustpan where the lip of the dustpan is curved outwards. U.S. Pat. No. 2,563,223, issued Aug. 7, 1951 to Carl M. Dreher, describes a grocer's scoop where the leading edge of the scoop is curved inwards.

U.S. Pat. No. 3,917,333, issued Nov. 4, 1975 to Donald J. Grattan, discloses a sanitary scoop where one edge of the scoop is serrated. The sanitary scoop is foldable and designed so that a person's hand may push the serrated edge along a surface to scoop up animal waste.

U.S. Pat. No. 5,325,565, issued Jul. 5, 1994 to Yasuhiro Suzuki, describes a device for collecting dust, water or the like. The device features a downward sloping blade with a straight edge. U.S. Pat. No. 5,473,790, issued Dec. 12, 1995 to Roger Demarais, demonstrates a collapsible dustpan with a dirt retaining rib along the front edge, or lip. The dirt retaining rib is straight rather than curved. U.S. Pat. No. 5,738,399, issued Apr. 14, 1998 to Melanie Mitchell, shows a cat litter scoop with a beveled scraping edge. U.S. Pat. No. 6,234,549, issued May 22, 2001 to Marcia A. Brownell, shows a dual action scooper for clumping and non-clumping cat litter. The leading edge is V-shaped but is not scalloped.

U.S. Pat. No. 6,237,181, issued May 29, 2001 to Dawn L. Onnuffer, discloses a comb for removing debris on carpet that features a plurality of teeth on the distal end. U.S. Pat. No. 6,249,930, issued Jun. 26, 2001 to David D. Noggle, describes a dustpan with a flexibly movable bottom wall that conforms to the floor contour. Japanese Patent No. 8-98,790, published on Apr. 16, 1996, shows a dustpan-shaped device where the leading edge has an attached rubber spatula.

None of the above inventions and patents, taken either singly or in combination, is seen to describe the instant invention as claimed. Thus a scalloped edge dustpan solving the aforementioned problems is desired.

SUMMARY OF THE INVENTION

The scalloped edge dustpan is meant to eliminate the line of dust or debris that is often left on the floor when dust or debris: is swept into a typical dustpan. The term "scalloped" is given its common dictionary definition of meaning, i.e., having a "continuous series of semicircular segments or projections forming a border."

When debris is swept into a dustpan having a scalloped edge according to the present invention, any debris that might get left on the edge of a conventional straight-edge dustpan is, trapped in the space between the scallops. When the dustpan is removed there is no line of debris remaining.

The scalloped edge may be used on any type of dustpan. The various types of dustpans in current use include the following: standing dustpans, upright dustpans, self-opening dustpans, self-closing dustpans, janitor dustpans, lobby dustpans and the shovels used for removing ashes from fireplaces. The scalloped edge can be incorporated into any of these types of dustpans.

The scalloped edge dustpan can be manufactured by methods currently known in the art, typically molding or casting. The scalloped edge may be incorporated in the molding or casting so that the scalloped edge is of one-piece construction. Alternatively, the scalloped edge may be manufactured as a separate component and joined to the blade of the dustpan by adhesive, rivets, or other fasteners as an after market modification to a typical straight edge dustpan. The scalloped edge may be made from plastic, metal, rubber, or other appropriate material.

Accordingly, it is a principal object of the invention to provide a dustpan having a scalloped edge which does not leave the line of debris that normally remains after sweeping dust or debris into a conventional straight edged dustpan.

It is another object of the invention to make available the scalloped edge for use in conventional dustpans as an after market improvement.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
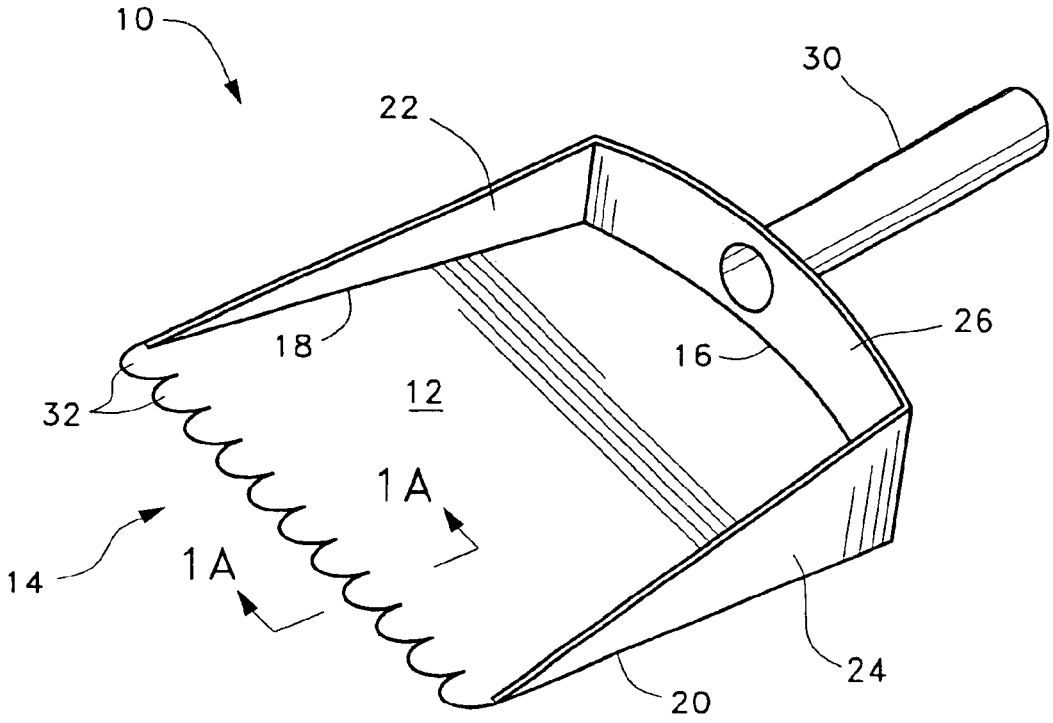
FIG. 1 is a perspective view of a scalloped edge dustpan according to the present invention.
Figure 2:
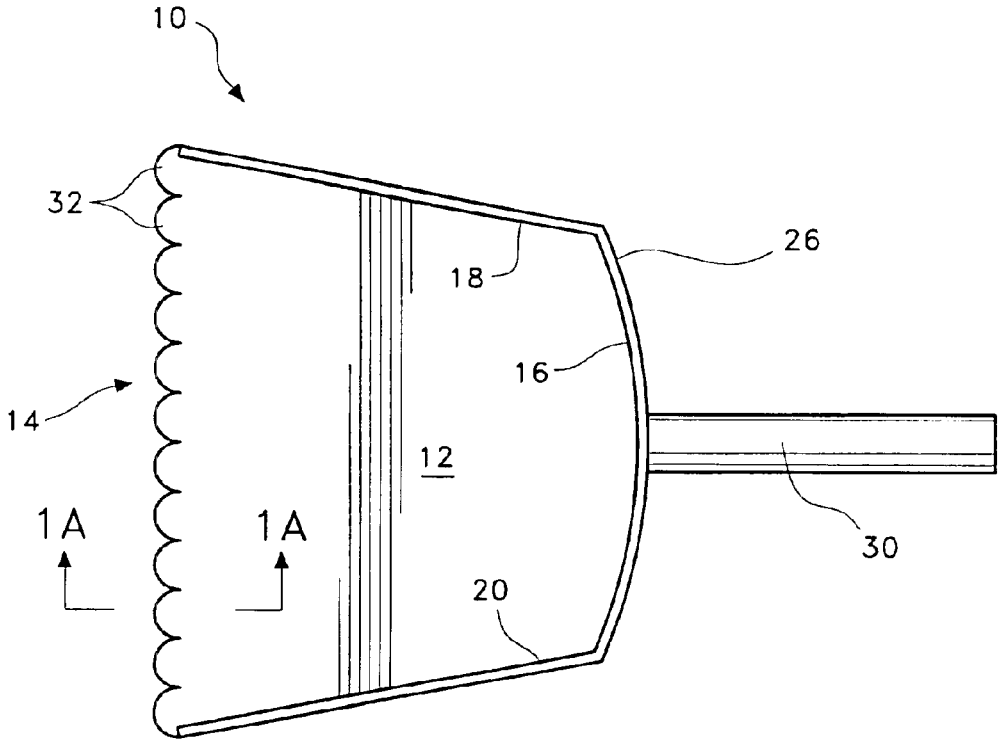
FIG. 2 is a top view of the scalloped edge dustpan according to the present invention.

The present invention is a scalloped edge dustpan, designated generally as 10 in the drawings. As shown in FIGS. 1 and 2, the scalloped edge dustpan includes a blade or flat base 12 which is of generally rectangular configuration, a leading scalloped edge 14, a rear edge 16, and a pair of opposed side edges 18 and 20. Extending upwardly from the side edges 18 and 20 are side walls 22 and 24. Side walls 22 and 24 are of a triangular configuration and join opposite ends of a rear wall 26 which extends upwardly from the rear edge 16. A handle 30 extends outward from the rear wall 26 and is perpendicular to the rear wall 26.

Figure 1A:
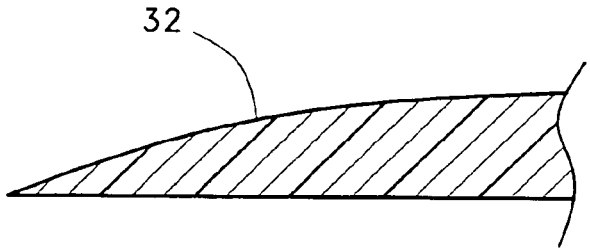
FIG. 1A is a section view along lines 2—2 of FIG. 1.

The most important feature of the scalloped edge dustpan 10 is the scalloped edge 14. The scalloped edge 14 is a continuous series of semicircular segments or projections forming the front border of the dustpan 10. The individual scallops 32 are arranged in a line side by side along the entire length of the leading edge 14 of the dustpan 10. The individual scallops 32 may be: beveled, as shown in FIG. 1A, so that the leading edge 14 is ramped up to the body of the base 12. By having the individual scallops 32 beveled, when debris is swept into the dustpan 10, debris will be not become caught on the outer edge of the individual scallops 32.

The scalloped edge dustpan 10 as embodied in FIGS. 1 and 2 is preferably of one-piece construction. The scalloped edge dustpan 10 can be molded or cast by methods known in the art from materials known in the art, such as plastics, metals or rubber. It will be understood that the body of the dustpan may have any conventional shape or configuration known in the art, including standing dustpans, upright dustpans, self-opening dustpans, self-closing dustpans, janitor dustpans, lobby dustpans and the shovels used for removing ashes from fireplaces, provided that the dustpan has a scalloped leading edge 14. Further, the body of the dustpan may include additional features not shown in the drawings, e.g., a hood extending across the rear of the dustpan for preventing dust or debris from being swept over the rear wall 26.

It will further be understood that the scalloped leading edge 14 may be made either from a relatively rigid material, such as metal or hard plastics, or from flexible materials, such as natural or synthetic rubber or soft plastics, which have sufficient resilience to retain their shape.

Figure 3:
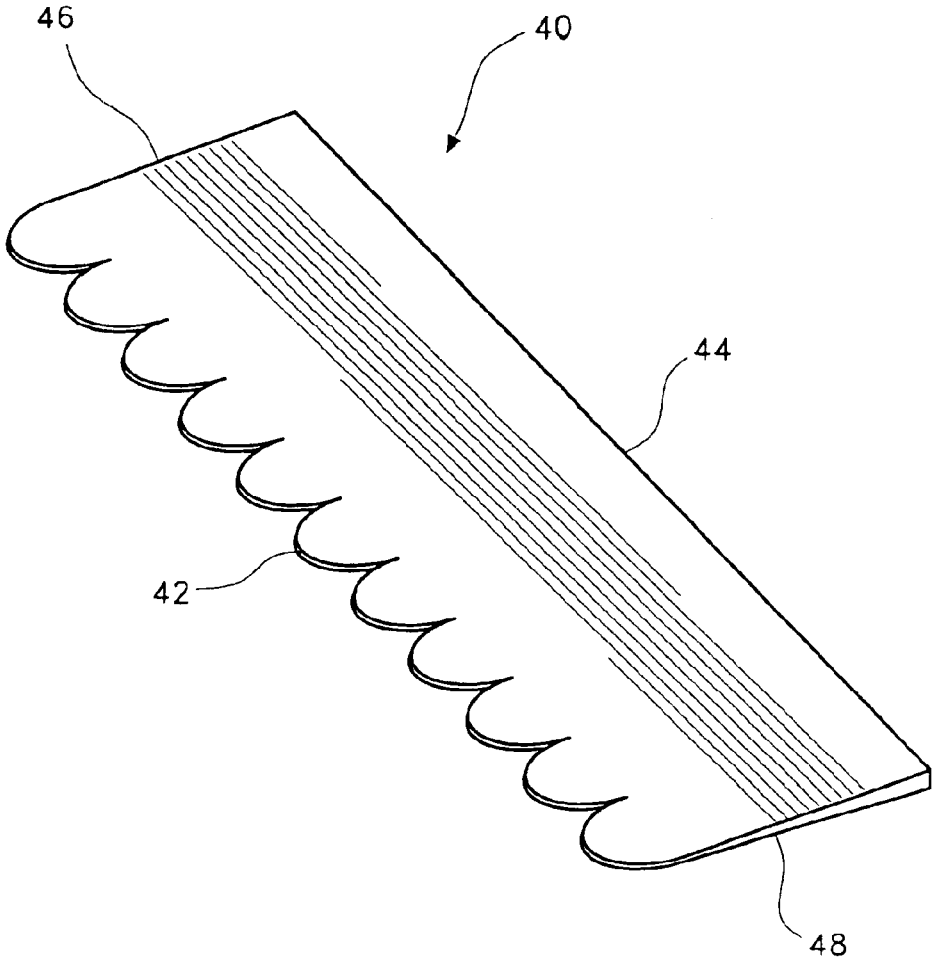
FIG. 3 is a perspective view of a scalloped edge for a dustpan according to the present invention which is adapted for attachment to the leading edge of a conventional dustpan.

Alternatively, the scalloped leading edge may be formed as a separate piece that is joined to the front of the base 12 by any conventional means. As shown in FIG. 3, a scalloped edge 42 is formed on the forward edge of a generally rectangular strip of plastic or metal that serves as a dustpan attachment 40. The dustpan attachment 40 has a scalloped edge 42, a rear edge 44, and two side edges 46 and 48. The dustpan attachment can be attached to a conventional straight-edged dustpan. Therefore the conventional straight-edged dustpan will have the benefit of a scalloped edge 42. The dustpan attachment 40 can be attached to a conventional straight edged dustpan by using adhesive, such as thermal resin, or by means of fasteners, such as rivets or screws.

It is to be understood that the present invention is not limited to the embodiments described above, but encompasses any and all embodiments within the scope of the following claims.

I claim:

1. A scalloped edge dustpan, comprising:

a substantially flat, rectangular base having a front edge, rear edge opposite the front edge, and a pair of opposing side edges extending between the front and rear edges, the front edge being formed as a continuous series of semicircular protruding segments defining a scalloped edge;

a rear wall extending upward from the rear edge of the base; and a pair of side walls extending upward from the side edges and joining opposing ends of the rear wall.

2. The scalloped edge dustpan according to claim 1, wherein each of the semicircular segments forming the scalloped edge is beveled, each of the beveled semicircular segments sloping downwards.

3. The scalloped edge dustpan according to claim 1, further comprising a handle extending from said rear wall.

4. The scalloped edge dustpan according to claim 1, wherein the dustpan is made of metal.

5. The scalloped edge dustpan according to claim 1, wherein the dustpan is made of rubber.

6. The scalloped edge dustpan according to claim 1, wherein the dustpan is made of plastic.

7. The scalloped edge dustpan according to claim 1, wherein said base and said scalloped edge are formed from a single, integral piece of material.

8. The scalloped edge dustpan according to claim 1, wherein said base and said scalloped edge are formed as separate components, said scalloped edge being joined to said base.

9. A scalloped edge with a dustpan, comprising:

a planar strip of substantially rectangular shape having a front edge, a rear edge opposing the front edge, and two side edges extending between the front edge and the rear edge, the front edge being formed in a continuous series of semicircular protruding segments defining a scalloped edge, the strip being attached to a front end of a blade of the dustpan.

10. The scalloped edge according to claim 9, wherein each said semicircular segment is beveled, each of said beveled semicircular segments sloping downwards.

11. The scalloped edge according to claim 9, wherein said strip is made of metal.

12. The scalloped edge according to claim 9, wherein said strip is made of rubber.

13. The scalloped edge according to claim 9, wherein said strip is made of plastic.

14. The scalloped edge according to claim 9, wherein the rear edge of the strip is thicker than the front edge of the strip.

* * * * *